US010475390B2

(12) United States Patent
Shi

(10) Patent No.: US 10,475,390 B2
(45) Date of Patent: Nov. 12, 2019

(54) SCANNING DRIVING CIRCUIT AND DISPLAY APPARATUS

(71) Applicant: Shenzhen China Star Optoelectronics Semiconductor Display Technology Co., Ltd., Shenzhen, Guangdong (CN)

(72) Inventor: Longqiang Shi, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 150 days.

(21) Appl. No.: 15/557,443

(22) PCT Filed: Aug. 18, 2017

(86) PCT No.: PCT/CN2017/097982
§ 371 (c)(1),
(2) Date: Sep. 11, 2017

(87) PCT Pub. No.: WO2019/010752
PCT Pub. Date: Jan. 17, 2019

(65) Prior Publication Data

US 2019/0019460 A1 Jan. 17, 2019

(30) Foreign Application Priority Data

Jul. 12, 2017 (CN) ..... 2017 1 0565240

(51) Int. Cl.
*G09G 3/3266* (2016.01)
*G09G 3/36* (2006.01)

(52) U.S. Cl.
CPC ..... *G09G 3/3266* (2013.01); *G09G 3/3677* (2013.01); *G09G 2310/06* (2013.01);
(Continued)

(58) Field of Classification Search
CPC combination set(s) only.
See application file for complete search history.

(56) References Cited

U.S. PATENT DOCUMENTS

2011/0142192 A1* 6/2011 Lin ..... G09G 3/3677 377/77
2015/0171833 A1 6/2015 Pi et al.
(Continued)

FOREIGN PATENT DOCUMENTS

CN 203325416 A 12/2013
CN 106898590 A 6/2017

*Primary Examiner* — Amr A Awad
*Assistant Examiner* — Andre L Matthews
(74) *Attorney, Agent, or Firm* — Andrew C. Cheng

(57) ABSTRACT

The present application discloses a scanning driving circuit and a display apparatus. The scanning driving circuit includes a scanning signal output terminal to output a scanning signal; a pull-up circuit for receiving a first clock signal and controlling the scanning signal output terminal to output a high level scanning signal; a transmission circuit for outputting a stage transmission signal of a current stage; a pull-up control circuit receiving a stage transmission signal of a previous stage and a second clock signal to charge the pull-up control signal point; a pull-down maintenance circuit receiving the second clock signal to maintain low levels of the pull-up control signal point, and the scanning signal output terminal; and a bootstrap circuit for raising the potential of the pull-up control signal point, to solve the problem that the power consumption of the scanning driving circuit increases due to the leakage of the controllable switch.

11 Claims, 3 Drawing Sheets

(52) U.S. Cl.
CPC . *G09G 2310/08* (2013.01); *G09G 2320/0214* (2013.01); *G09G 2320/04* (2013.01); *G09G 2330/021* (2013.01)

(56) References Cited

U.S. PATENT DOCUMENTS

| | | | | |
|---|---|---|---|---|
| 2015/0279288 | A1 | 10/2015 | Dai et al. | |
| 2015/0317954 | A1* | 11/2015 | Jang | G09G 3/20 345/213 |
| 2016/0140922 | A1* | 5/2016 | Dai | G11C 19/287 345/92 |
| 2016/0248417 | A1 | 8/2016 | Xiao | |
| 2016/0253976 | A1* | 9/2016 | Jang | G09G 3/3677 345/208 |
| 2017/0169778 | A1 | 6/2017 | Mei | |
| 2017/0178582 | A1* | 6/2017 | Li | G09G 3/3607 |
| 2018/0211623 | A1* | 7/2018 | Shi | G09G 3/3677 |
| 2018/0211626 | A1* | 7/2018 | Shi | G09G 3/3677 |
| 2019/0057663 | A1* | 2/2019 | Shi | G09G 3/3677 |

* cited by examiner

SCANNING DRIVING CIRCUIT AND DISPLAY APPARATUS

FIELD OF THE INVENTION

The present application relates to a display technology field, and more particularly to a scanning driving circuit and a display apparatus.

BACKGROUND OF THE INVENTION

Gate Driver on Array, GOA technology is conducive to the design of narrow bezel of the display panel and cost reduction, so it is widely used and studied. Indium Gallium Zinc Oxide, IGZO thin film transistor has high mobility and fine device stability, it can reduce the complexity of the scanning driving circuit, due to the high mobility of IGZO thin film transistor makes the size of the thin film transistor of the scanning driving circuit is relatively small, that is advantageous for the fabrication of narrow bezel of the display apparatus; secondly, due to the device stability of the IGZO thin film transistor, the number of the power and thin film transistors used to stabilize the performance of the thin film transistor can be reduced, therefore making the circuit simple and with low power consumption. The current IGZO thin film transistor belongs to depletion-type thin film transistor, its threshold voltage, Vth is negative value, so only the turn-on voltage of the thin film transistor is negative can completely turn off the thin film transistor, if the film transistor cannot be effectively turned off, it will cause leakage, resulting in power consumption of the circuit is increased.

SUMMARY OF THE INVENTION

The technical problem that the present application mainly solves is to provide a scanning driving circuit and a display apparatus to solve the problem of the increased circuit power consumption caused by the leakage of the thin film transistor.

In order to solve the above technical problem, a technical aspect of the present application is to provide a scanning driving circuit, the scanning driving circuit includes a plurality of scanning driving units connected successively, each of the scanning driving unit includes:

a scanning signal output terminal used for outputting a high level scanning signal or a low level scanning signal;

a pull-up circuit used for receiving a first clock signal and controlling the scanning signal output terminal to output a high level scanning signal in accordance with the first clock signal;

a transmission circuit connected to the pull-up circuit for outputting a stage transmission signal of a current stage;

a pull-up control circuit connected to the transmission circuit for receiving a stage transmission signal of a previous stage and a second clock signal to charge the pull-up control signal point to pull-up the potential of the pull-up control signal point to a high level;

a pull-down maintenance circuit connected to the pull-up control circuit, a first voltage terminal, and a second voltage terminal for receiving the second clock signal to maintain a low level of the pull-up control signal point, and a low level of the scanning signal outputted from the scanning signal output terminal; and a bootstrap circuit for raising the potential of the pull-up control signal point, the pull-up circuit comprising a first controllable switch, a first terminal of the first controllable switch receiving the first clock signal and is connected to the transmission circuit, a control terminal of the first controllable switch is connected to the transmission circuit, a second terminal of the first controllable switch is connected to the scanning signal output terminal; and the first clock signal and the second clock signal are both high-frequency alternating current, and the potential is reversed, the first voltage terminal and the second voltage terminal output low voltage direct current, and a voltage outputted from the second voltage terminal is lower than a voltage outputted from the first voltage terminal.

In order to solve the above technical problem, a technical aspect of the present application is to provide a scanning driving circuit, the scanning driving circuit includes a plurality of scanning driving units connected successively, each of the scanning driving unit includes:

a scanning signal output terminal used for outputting a high level scanning signal or a low level scanning signal;

a pull-up circuit used for receiving a first clock signal and controlling the scanning signal output terminal to output a high level scanning signal in accordance with the first clock signal;

a transmission circuit connected to the pull-up circuit for outputting a stage transmission signal of a current stage;

a pull-up control circuit connected to the transmission circuit for receiving a stage transmission signal of a previous stage and a second clock signal to charge the pull-up control signal point to pull-up the potential of the pull-up control signal point to a high level;

a pull-down maintenance circuit connected to the pull-up control circuit, a first voltage terminal, and a second voltage terminal for receiving the second clock signal to maintain a low level of the pull-up control signal point, and a low level of the scanning signal outputted from the scanning signal output terminal; and a bootstrap circuit for raising the potential of the pull-up control signal point.

In order to solve the above technical problem, a technical aspect of the present application is to provide a display apparatus, the display apparatus includes a scanning driving circuit, the scanning driving circuit includes a plurality of scanning driving units connected successively, each of the scanning driving unit includes:

a scanning signal output terminal used for outputting a high level scanning signal or a low level scanning signal;

a pull-up circuit used for receiving a first clock signal and controlling the scanning signal output terminal to output a high level scanning signal in accordance with the first clock signal;

a transmission circuit connected to the pull-up circuit for outputting a stage transmission signal of a current stage;

a pull-up control circuit connected to the transmission circuit for receiving a stage transmission signal of a previous stage and a second clock signal to charge the pull-up control signal point to pull-up the potential of the pull-up control signal point to a high level;

a pull-down maintenance circuit connected to the pull-up control circuit, a first voltage terminal, and a second voltage terminal for receiving the second clock signal to maintain a low level of the pull-up control signal point, and a low level of the scanning signal outputted from the scanning signal output terminal; and a bootstrap circuit for raising the potential of the pull-up control signal point.

The advantages of the present application is: comparing to the conventional technology, the scanning driving circuit according to the present application can prevent the leakage by the pull-up circuit, the transmission circuit, the pull-up control circuit, the pull-down maintenance circuit and the bootstrap circuit, and then solve the issue of the increase of the power consumption of the scanning driving circuit caused by the leakage of controllable switch.

BRIEF DESCRIPTION OF THE DRAWINGS

In order to more clearly illustrate the embodiments of the present application or prior art, the following FIG.s will be described in the embodiments are briefly introduced. It is obvious that the drawings are merely some embodiments of the present application, those of ordinary skill in this field can obtain other FIG.s according to these FIG.s without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts acquired should be considered within the scope of protection of the present application.

Specifically, the terminologies in the embodiments of the present application are merely for describing the purpose of the certain embodiment, but not to limit the invention.

Figure 1:
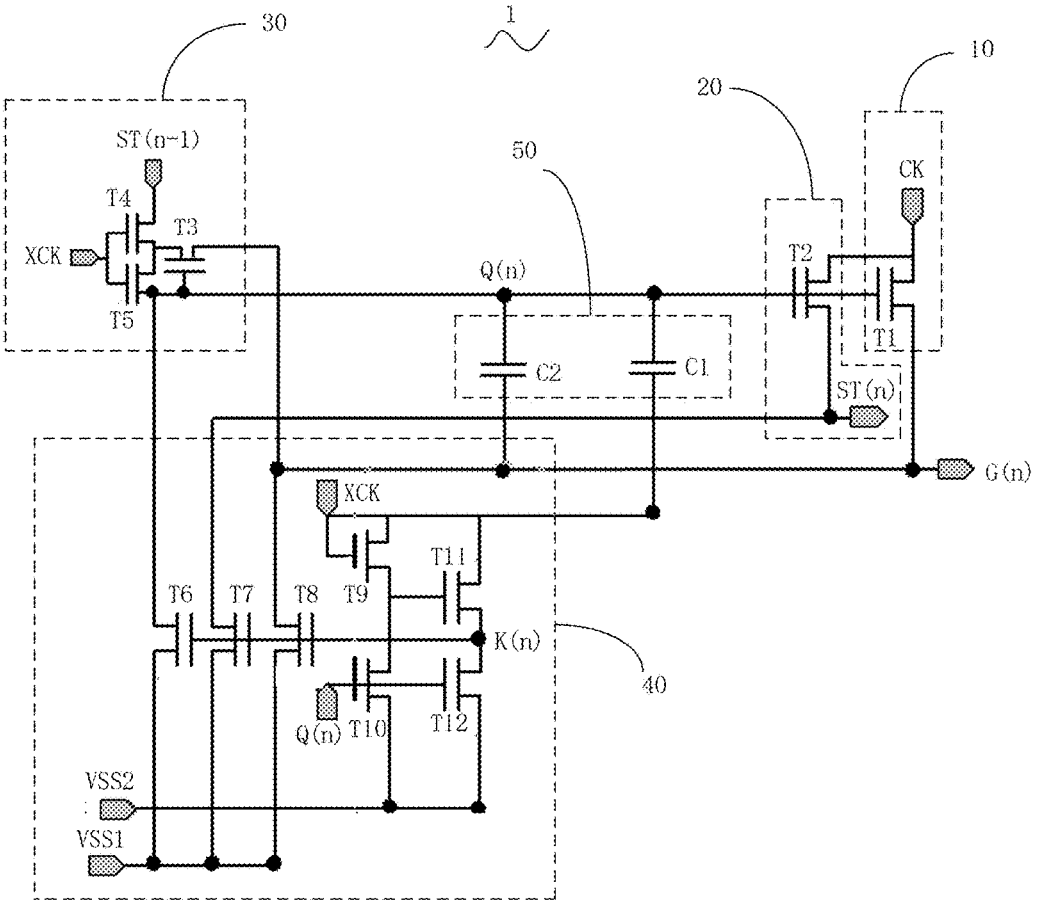
FIG. 1 is a circuit diagram of each scanning driving unit of the scanning driving circuit of the present application.
Figure 2:
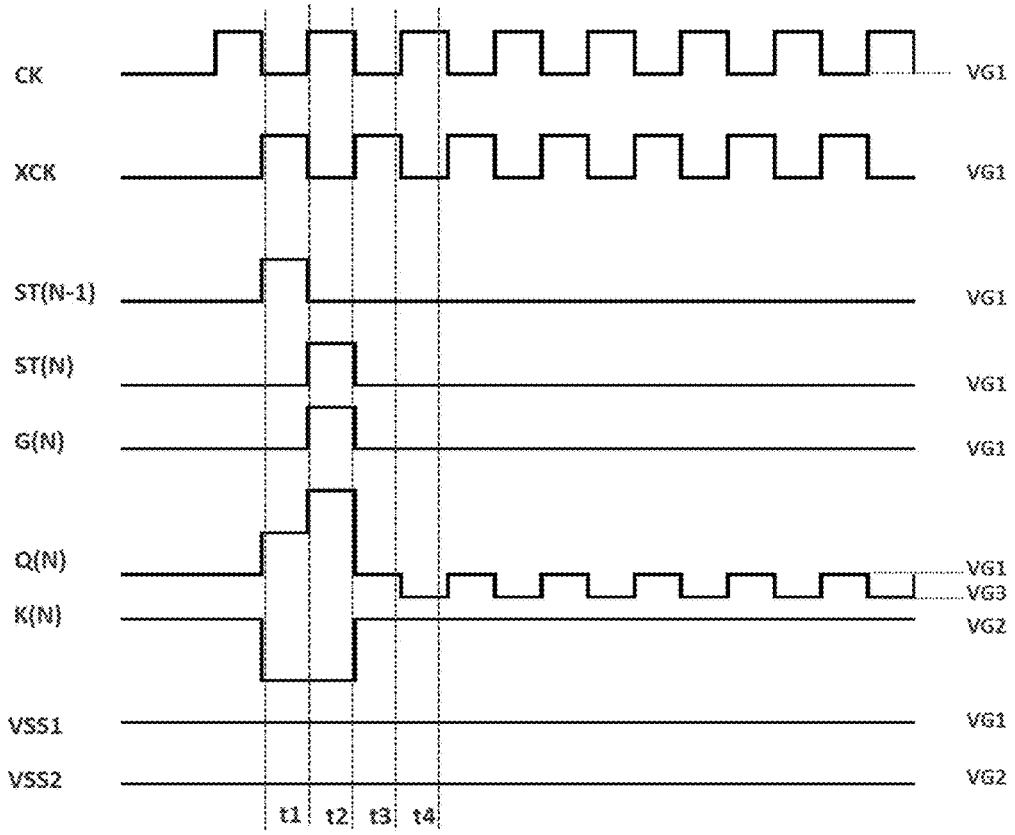
FIG. 2 is a schematic diagram of the signal waveform of FIG. 1.

Referring to FIG. 1, FIG. 1 is a circuit diagram of each scanning driving unit of the scanning driving circuit of the present application. The scanning driving circuit includes a plurality of scanning driving units 1 connected successively, each of the scanning driving unit 1 includes a scanning signal output terminal G(n) for outputting a high level scanning signal or a low level scanning signal;

A pull-up circuit 10 for receiving a first clock signal CK and controlling the scanning signal output terminal G(n) to output a high level scanning signal in accordance with the first clock signal CK;

A transmission circuit 20 connected to the pull-up circuit 10 for outputting the stage transmission signal of the current stage st(n);

A pull-up control circuit 30 connected to the transmission circuit 20 for receiving a stage transmission signal of the previous stage ST(n−1) and a second clock signal XCK to charge the pull-up control signal point Q(n) to pull-up the potential of the pull-up control signal point Q(n) to a high level;

A pull-down maintenance circuit 40 connected to the pull-up control circuit 30, a first voltage terminal VSS1, and a second voltage terminal VSS2 for receiving the second clock signal XCK to maintain a low level of the pull-up control signal point Q(n), and a low level of the scanning signal outputted from the scanning signal output terminal G(n).

A bootstrap circuit 50 for raising the potential of the pull-up control signal point Q(n). Specifically, the pull-up circuit 10 includes a first controllable switch T1, a first terminal of the first controllable switch T1 receiving the first clock signal CK and connecting to the transmission circuit 20, a control terminal of the first controllable switch T1 is connected to the transmission circuit 20, and a second terminal of the first controllable switch T1 is connected to the scanning signal output terminal G(n). Specifically, the transmission circuit 20 includes a second controllable switch T2, a control terminal of the second controllable switch T2 is connected to the control terminal of the first controllable switch T1, and a first terminal of the second controllable switch T2 is connected to the first terminal of the first controllable switch T1, and a second terminal of the second controllable switch T2 outputs the stage transmission signal of the current stage st(n).

Specifically, the pull-up control circuit 30 includes third to fifth controllable switches T3-T5, a control terminal of the third controllable switch T3 is connected to the control terminal of the second controllable switch T2, a second terminal of the controllable switch T5 and the pull-down maintenance circuit 40, a first terminal of the third controllable switch T3 is connected to a second terminal of the fourth controllable switch T4 and a first terminal of the fifth controllable switch T5, a second terminal of the third controllable switch T3 is connected to the pull-down maintenance circuit 40 and the scanning signal output terminal G(n), a first terminal of the fourth controllable switch T4 receiving the stage transmission signal of the previous stage ST(n−1), a control terminal of the fourth controllable switch T4 is connected to a control terminal of the fifth controllable switch T5 and receives the second clock signal XCK.

Specifically, the pull-down maintenance circuit 40 includes sixth to twelfth controllable switches T6-T12, a control terminal of the sixth controllable switch T6 is connected to a control terminal of the seventh controllable switch T7 and a control terminal of the eighth controllable switch T8, a first terminal of the sixth controllable switch T6 is connected to the second terminal of the fifth controllable switch T5, a second terminal of the sixth controllable switch T6 is connected to a first voltage terminal VSS1, a first terminal of the seventh controllable switch T7 is connected to the second terminal of the second controllable switch T2, a second terminal of the seventh controllable switch T7 is connected to the first voltage terminal VSS1, a first terminal of the eighth controllable switch T8 is connected to the second terminal of the third controllable switch T3, a second terminal of the eighth controllable switch T8 is connected to the first voltage terminal VSS1, a control terminal of the ninth controllable switch T9 is connected to a first terminal of the ninth controllable switch T9 and a first terminal of the eleventh controllable switch T11 and receives the second clock signal XCK, a second terminal of the ninth controllable switch T9 is connected to a first terminal of the tenth controllable switch T10 and a control terminal of the eleventh controllable switch T11, a control terminal of the tenth controllable switch T10 is connected to a control terminal of the twelfth controllable switch T12 and the pull-up control signal point Q(n), a second terminal of the tenth controllable switch T10 is connected to a second voltage terminal VSS2, a second terminal of the eleventh controllable switch T11 is connected to a first terminal of the twelfth controllable switch T12 and the control terminal of the eighth controllable switch T8, and a second terminal of the twelfth controllable switch T12 is connected to the second voltage Terminal VSS2.

Specifically, the bootstrap circuit 50 includes a first capacitor C1 and a second capacitor C2, a terminal of the first capacitor C1 is connected to the control terminal of the second controllable switch T2, the other terminal of the first capacitor C1 is connected to the first terminal of the eleventh controllable switch T11, a terminal of the second capacitor C2 is connected to the control terminal of the third controllable switch T3, and the other terminal of the second capacitor C2 is connected to the second terminal of the third terminal of the third controllable switch T3.

In the present embodiment, the first to twelfth controllable switches T1-T12 are N-type thin film transistors, the control terminals, the first terminals and the second terminals of the first to twelfth controllable switches T1-T12 are respectively correspond to gates, sources and drains of the N-type thin film transistor. In other embodiments, the first to twelfth controllable switches can be other types of switches as long as the object of the present application can be achieved.

In the present embodiment, the first clock signal CK and the second clock signal XCK are both high-frequency alternating current and the potential is reversed, that is, when the first clock signal CK is at a high potential, the second clock signal XCK is at a low potential, when the first clock signal CK is at a low potential, the second clock signal XCK is at a high potential, when the high and low potentials of the first clock signal CK and the second clock signal XCK are VGH and VGL, respectively, the first voltage terminal VSS1 and the second voltage terminal VSS2 output low voltage direct current, and the output voltage of the second voltage terminal VSS2 is VG2, the output voltage of the first voltage terminal VSS1 is VG1, and the output voltage of the second voltage terminal VSS2 is lower than the output voltage of the first voltage terminal VSS1.

The operation principle of the scanning driving circuit is described as follows:

The first stage (t1), that is the pre-charge stage of the pull-up control signal point Q(n): the second clock signal XCK and the stage transmission signal of the previous stage ST(n−1) are both at high level at this stage, the fourth controllable switch T4 and the fifth controllable switch T5 are both turned on, the pull-up control signal point Q(n) is pre-charged to a high potential; and at the same time, since the pull-up control signal point Q(N) is a high potential, the tenth controllable switch T10 and the twelfth controllable switch T12 are both turned on, a node K(n) obtains the low potential of the second voltage terminal VSS2 due to the resistance dividing function of the controllable switch, so that the sixth to eighth controllable switches T6-T8 are turned off.

The second stage (t2), that is the bootstrap stage of the pull-up control signal point Q(n): the second clock signal XCK is at a low level at this stage, the fourth and fifth controllable switches T4 and T5 are both turned off, but the first and second controllable switches T1 and T2 are turned on because the pull-up control signal point Q(n) is pre-charged with a high potential, the high potential of the first clock signal CK is written to the scanning signal output terminal G(n) at this time, the pull-up control signal point Q(n) rises to a higher potential due to the capacitive coupling effect of the second capacitor C2 and makes the first controllable switch T1 is fully turned on and is more advantageous for the fast charging of the scanning signal output terminal G(n).

It is to be noted that, in order to prevent the leakage of the high potential of the pull-up control signal point Q(n) from the pull-up control circuit 30, the structure composing the third to fifth controllable switches T3-T5 are used in the scanning driving circuit, the pull-up control signal point Q(n) is at high potential, the third controllable switch T3 is turned on, and at this time, the high potential of the scanning signal output terminal G(n) is written to the source of the fifth controllable switch T5, that is the node of the fourth controllable switch T4 and the fifth controllable switch T5, the voltage Vgs between the gate and the source of the fifth controllable switch T5 is Vgs=XCK−VGH=VG1−VGH<<0, so that the fifth controllable switch T5 is completely turned off.

In order to prevent the leakage of the high potential of the pull-up control signal point Q(n) from the sixth controllable switch T6, the first voltage terminal VSS1 and the second voltage terminal VSS2 are used, the voltage Vgs between the gate and the source of the sixth controllable switch T6 is Vgs=V_K(N)−VSS1=VGL2−VGL1<<0, so that the sixth controllable switch T6 is completely turned off.

The third stage (t3), that is the pull down stage of the pull-up control signal point Q(n): the second clock signal XCK is at high potential at this stage, the fourth and fifth controllable switches T4 and T5 are both turned on, the low potential of the stage transmission signal of the previous stage ST(n−1) is written to, so the pull-up control signal point Q(n) is pulled down, at the same time, since the potential of the pull-up control signal point Q(n) is lower, the tenth and twelfth controllable switches T10 and T12 are gradually turned off, since the second clock signal XCK is at high potential at this time, so the ninth and eleventh controllable switches T9 and T11 are turned on, the node K(n) becomes a high potential due to the resistance dividing function of the controllable switch, the sixth to eighth controllable switches T6-T8 are turned on, the potential of the pull-up control signal point Q(N) is further pulled down faster by the sixth controllable switch t6 to a low potential of the first voltage terminal VSS1, and scanning signal output terminal G(n) is pulled down to a low potential by the eighth controllable switch T8.

The fourth state (T4), that is the pull-down maintenance stage of the pull-up control signal point Q(n): at this stage, when the second clock signal XCK changes from the high potential to the low potential, by the coupling effect of the first capacitor C1, the pull-up control signal point Q(n) is pulled down to a lower potential, and the voltage Vgs between the gate and the source of the first controllable switch T1 is Vgs=V_Q(N)−V_G(N)=VGL3−VGL1<0, the first controllable switch T1 is completely turned off to prevent the high potential of the first clock signal CK from being written to the scanning signal output terminal G(n) at the time and causing erroneous start-up.

It is to be noted that, if the second clock signal XCK and the first capacitor C1 are not used in the pull-down maintenance module 40, the potential of the pull-up control signal point Q(n) is kept maintaining at the potential of VGL at the maintenance stage, therefore, the voltage Vgs between the gate and the source of the first controllable switch T1 is Vgs=V_Q(N)−V_G(N)=VGL1−VGL1=0, since the threshold voltage Vth of the first controllable switch T1 is negative, the first controllable switch T1 is not sufficiently turned off, the high potential of the first clock signal CK is written to the scanning signal output terminal G(n), therefore resulting in abnormal display and increased power consumption.

Figure 3:
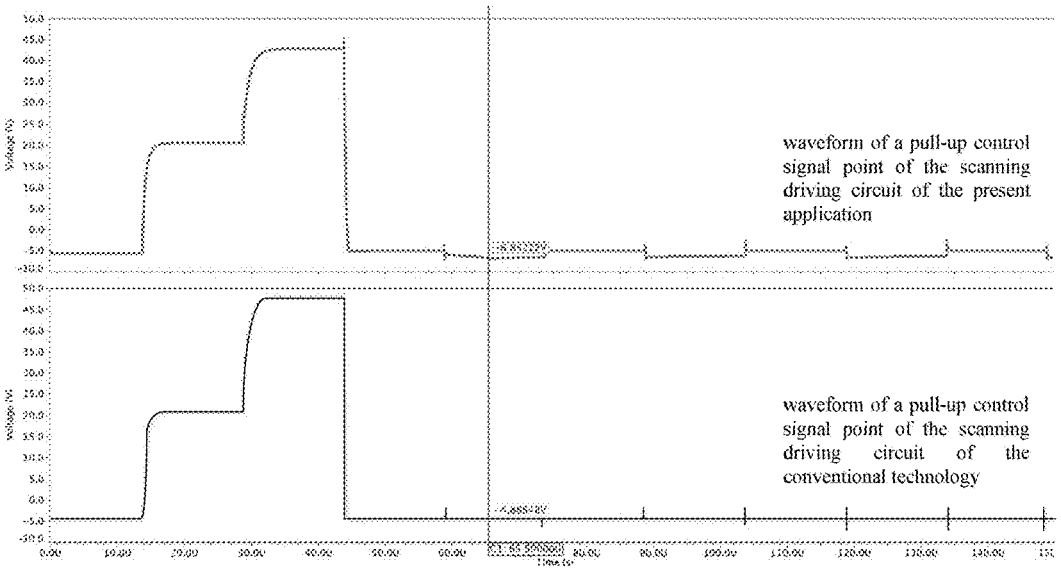
FIG. 3 is a schematic diagram of a waveform of a pull-up control signal point of the scanning driving circuit of the present application and a conventional scanning driving circuit.

Referring to FIG. 3, there is shown a schematic diagram of a pull-up control signal point of a scanning driving circuit of the present application and a conventional scanning driving circuit. Wherein taking the point of VGL=−5V, at this stage, when the potential of the first clock signal CK is high level, the potential of the pull-up control signal point Q(n) is −6.8 V, and the potential of the pull-up control signal point Q(n) of the conventional scanning driving circuit is −4.8V.

Figure 4:
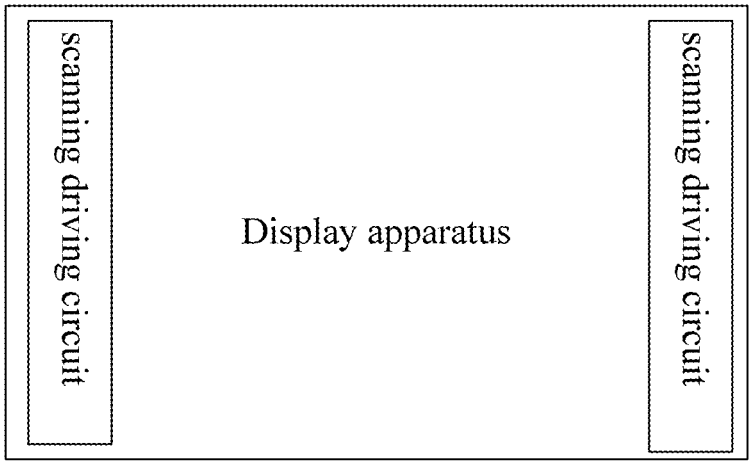
FIG. 4 is a schematic structural view of a display apparatus according to the present application.

Referring to FIG. 4, a schematic view of the structure of the display apparatus of the present application is shown. The display apparatus includes the above-mentioned scanning driving circuit, the scanning driving circuits are provided on the left and right sides of the display apparatus, the display apparatus is an LCD or an OLED, and other devices and functions of the display apparatus are the same with the devices and functions of the existing display apparatus, not repeat them here.

The scanning driving circuit prevents the leakage current by the pull-up circuit, the transmission circuit, the pull-up control circuit, the pull-down maintenance circuit and the bootstrap circuit, thereby solving the problem that the power consumption of the scanning driving circuit increases due to the leakage of the controllable switch.

Above are embodiments of the present application, which does not limit the scope of the present application. Any modifications, equivalent replacements or improvements within the spirit and principles of the embodiment described above should be covered by the protected scope of the invention.

What is claimed is:

1. A scanning driving circuit, wherein the scanning driving circuit comprises a plurality of scanning driving units connected successively, each of the scanning driving unit comprising:

a scanning signal output terminal used for outputting a high level scanning signal or a low level scanning signal;

a pull-up circuit used for receiving a first clock signal and controlling the scanning signal output terminal to output a high level scanning signal in accordance with the first clock signal;

a transmission circuit connected to the pull-up circuit for outputting a stage transmission signal of a current stage;

a pull-up control circuit connected to the transmission circuit for receiving a stage transmission signal of a previous stage and a second clock signal to charge the pull-up control signal point to pull-up the potential of the pull-up control signal point to a high level;

a pull-down maintenance circuit connected to the pull-up control circuit, a first voltage terminal, and a second voltage terminal for receiving the second clock signal to maintain a low level of the pull-up control signal point, and a low level of the scanning signal outputted from the scanning signal output terminal; and a bootstrap circuit for raising the potential of the pull-up control signal point;

wherein the pull-up circuit comprises a first controllable switch, a first terminal of the first controllable switch receiving the first clock signal and is connected to the transmission circuit, a control terminal of the first controllable switch is connected to the transmission circuit, a second terminal of the first controllable switch is connected to the scanning signal output terminal;

the transmission circuit comprises a second controllable switch, a control terminal of the second controllable switch is connected to the control terminal of the first controllable switch, a first terminal of the second controllable switch is connected to the first terminal of the first controllable switch, and a second terminal of the second controllable switch outputs the stage transmission signal of the current stage;

the pull-up control circuit comprises third to fifth controllable switches, a control terminal of the third controllable switch is connected to the control terminal of the second controllable switch, a second terminal of the fifth controllable switch and the pull-down maintenance circuit, a first terminal of the third controllable switch is connected to a second terminal of the fourth controllable switch and a first terminal of the fifth controllable switch, a second terminal of the third controllable switch is connected to the pull-down maintenance circuit and the scanning signal output terminal, a first terminal of the fourth controllable switch receiving the stage transmission signal of the previous stage, a control terminal of the fourth controllable switch is connected to a control terminal of the fifth controllable switch and receives the second clock signal.

2. The scanning driving circuit according to claim 1, wherein the pull-down maintenance circuit comprising sixth to twelfth controllable switches, a control terminal of the sixth controllable switch is connected to a control terminal of the seventh controllable switch and a control terminal of the eighth controllable switch, a first terminal of the sixth controllable switch is connected to the second terminal of the fifth controllable switch, a second terminal of the sixth controllable switch is connected to a first voltage terminal, a first terminal of the seventh controllable switch is connected to the second terminal of the second controllable switch, a second terminal of the seventh controllable switch is connected to the first voltage terminal, a first terminal of the eighth controllable switch is connected to the second terminal of the third controllable switch, a second terminal of the eighth controllable switch is connected to the first voltage terminal, a control terminal of the ninth controllable switch is connected to a first terminal of the ninth controllable switch and a first terminal of the eleventh controllable switch and receives the second clock signal, a second terminal of the ninth controllable switch is connected to a first terminal of the tenth controllable switch and a control terminal of the eleventh controllable switch, a control terminal of the tenth controllable switch is connected to a control terminal of the twelfth controllable switch and the pull-up control signal point, a second terminal of the tenth controllable switch is connected to a second voltage terminal, a second terminal of the eleventh controllable switch is connected to a first terminal of the twelfth controllable switch and the control terminal of the eighth controllable switch, and a second terminal of the twelfth controllable switch is connected to the second voltage terminal.

3. The scanning driving circuit according to claim 2, wherein the bootstrap circuit comprising a first capacitor and a second capacitor, a terminal of the first capacitor is connected to the control terminal of the second controllable switch, the other terminal of the first capacitor is connected to the first terminal of the eleventh controllable switch, a terminal of the second capacitor is connected to the control terminal of the third controllable switch, and the other terminal of the second capacitor is connected to the second terminal of the third terminal of the third controllable switch.

4. The scanning driving circuit according to claim 2, wherein the first to twelfth controllable switches are N-type thin film transistors, the control terminals, the first terminals and the second terminals of the first to twelfth controllable switches are respectively correspond to gates, sources and drains of the N-type thin film transistor.

5. The scanning driving circuit according to claim 1, wherein the first clock signal and the second clock signal are both high-frequency alternating current, and the potential is reversed, the first voltage terminal and the second voltage terminal output low voltage direct current, and a voltage outputted from the second voltage terminal is lower than a voltage outputted from the first voltage terminal.

6. A display apparatus, wherein the display apparatus comprising a scanning driving circuit, wherein the scanning driving circuit comprises a plurality of scanning driving units connected successively, each of the scanning driving unit comprising:

a scanning signal output terminal used for outputting a high level scanning signal or a low level scanning signal;

a pull-up circuit used for receiving a first clock signal and controlling the scanning signal output terminal to output a high level scanning signal in accordance with the first clock signal;

a transmission circuit connected to the pull-up circuit for outputting a stage transmission signal of a current stage;

a pull-up control circuit connected to the transmission circuit for receiving a stage transmission signal of a previous stage and a second clock signal to charge the pull-up control signal point to pull-up the potential of the pull-up control signal point to a high level;

a pull-down maintenance circuit connected to the pull-up control circuit, a first voltage terminal, and a second voltage terminal for receiving the second clock signal to maintain a low level of the pull-up control signal point, and a low level of the scanning signal outputted from the scanning signal output terminal; and a bootstrap circuit for raising the potential of the pull-up control signal point;

wherein the pull-up circuit comprises a first controllable switch, a first terminal of the first controllable switch receiving the first clock signal and is connected to the transmission circuit, a control terminal of the first controllable switch is connected to the transmission circuit, a second terminal of the first controllable switch is connected to the scanning signal output terminal;

the transmission circuit comprises a second controllable switch, a control terminal of the second controllable switch is connected to the control terminal of the first controllable switch, a first terminal of the second controllable switch is connected to the first terminal of the first controllable switch, and a second terminal of the second controllable switch outputs the stage transmission signal of the current stage;

the pull-up control circuit comprises third to fifth controllable switches, a control terminal of the third controllable switch is connected to the control terminal of the second controllable switch, a second terminal of the fifth controllable switch and the pull-down maintenance circuit, a first terminal of the third controllable switch is connected to a second terminal of the fourth controllable switch and a first terminal of the fifth controllable switch, a second terminal of the third controllable switch is connected to the pull-down maintenance circuit and the scanning signal output terminal, a first terminal of the fourth controllable switch receiving the stage transmission signal of the previous stage, a control terminal of the fourth controllable switch is connected to a control terminal of the fifth controllable switch and receives the second clock signal.

7. The display apparatus according to claim 6, wherein the pull-down maintenance circuit comprising sixth to twelfth controllable switches, a control terminal of the sixth controllable switch is connected to a control terminal of the seventh controllable switch and a control terminal of the eighth controllable switch, a first terminal of the sixth controllable switch is connected to the second terminal of the fifth controllable switch, a second terminal of the sixth controllable switch is connected to a first voltage terminal, a first terminal of the seventh controllable switch is connected to the second terminal of the second controllable switch, a second terminal of the seventh controllable switch is connected to the first voltage terminal, a first terminal of the eighth controllable switch is connected to the second terminal of the third controllable switch, a second terminal of the eighth controllable switch is connected to the first voltage terminal, a control terminal of the ninth controllable switch is connected to a first terminal of the ninth controllable switch and a first terminal of the eleventh controllable switch and receives the second clock signal, a second terminal of the ninth controllable switch is connected to a first terminal of the tenth controllable switch and a control terminal of the eleventh controllable switch, a control terminal of the tenth controllable switch is connected to a control terminal of the twelfth controllable switch and the pull-up control signal point, a second terminal of the tenth controllable switch is connected to a second voltage terminal, a second terminal of the eleventh controllable switch is connected to a first terminal of the twelfth controllable switch and the control terminal of the eighth controllable switch, and a second terminal of the twelfth controllable switch is connected to the second voltage terminal.

8. The display apparatus according to claim 7, wherein the bootstrap circuit comprising a first capacitor and a second capacitor, a terminal of the first capacitor is connected to the control terminal of the second controllable switch, the other terminal of the first capacitor is connected to the first terminal of the eleventh controllable switch, a terminal of the second capacitor is connected to the control terminal of the third controllable switch, and the other terminal of the second capacitor is connected to the second terminal of the third terminal of the third controllable switch.

9. The display apparatus according to claim 7, wherein the first to twelfth controllable switches are N-type thin film transistors, the control terminals, the first terminals and the second terminals of the first to twelfth controllable switches are respectively correspond to gates, sources and drains of the N-type thin film transistor.

10. The display apparatus according to claim 6, wherein the first clock signal and the second clock signal are both high-frequency alternating current, and the potential is reversed, the first voltage terminal and the second voltage terminal output low voltage direct current, and a voltage outputted from the second voltage terminal is lower than a voltage outputted from the first voltage terminal.

11. The display apparatus according to claim 6, wherein the display apparatus is LCD or OLED.

* * * * *